US006397509B1

(12) United States Patent
Langner

(10) Patent No.: US 6,397,509 B1
(45) Date of Patent: Jun. 4, 2002

(54) BORE SIGHTING APPARATUS

(76) Inventor: F. Richard Langner, P.O. Box 14706, Scottsdale, AZ (US) 85267

( * ) Notice: Subject to any disclaimer, the term of this patent is extended or adjusted under 35 U.S.C. 154(b) by 0 days.

(21) Appl. No.: 09/533,461

(22) Filed: Mar. 23, 2000

(51) Int. Cl.[7] ..... F41G 1/00

(52) U.S. Cl. ..... 42/116; 42/111; 42/114; 42/119; 42/120; 42/121

(58) Field of Search ..... 42/115, 116, 120, 42/121; D22/100

(56) References Cited

U.S. PATENT DOCUMENTS

| | | | |
|---|---|---|---|
| 3,734,627 A | 5/1973 | Edwards | 356/153 |
| 4,079,534 A | 3/1978 | Snyder | 42/1 A |
| 4,295,289 A | 10/1981 | Snyder | 42/1 A |
| 4,481,561 A | 11/1984 | Lanning | 362/111 |
| 4,665,622 A | 5/1987 | Idan | 33/241 |
| 4,825,258 A | 4/1989 | Whitson | 365/153 |
| 5,031,349 A | 7/1991 | Vogel | 42/103 |
| 5,060,391 A | 10/1991 | Cameron | 33/234 |
| 5,454,168 A | 10/1995 | Langner | 33/234 |

*Primary Examiner*—Peter M. Poon
*Assistant Examiner*—Susan Piascik
(74) *Attorney, Agent, or Firm*—LaValle D. Ptak

(57) ABSTRACT

A bore sighting apparatus is designed to releasably fit into the muzzle of the barrel of a firearm for use in bore sighting of the firearm. The bore sighter includes a housing for a collimated light source, such as a laser, with an aperture for projecting the collimated light from a first end. The second end of the housing is coupled to a down-tapered, conical section which terminates in its tip at an elongated cylindrical extension for insertion into the barrel of a firearm. The elongated extension has an external diameter which is less than the smallest caliber of firearm with which the device is to be used. An O-ring on the extension is designed to frictionally center the extension within the barrel. The device is inserted until interference with the down-tapered portion and the muzzle of the firearm occurs to center the device. Rare earth magnets are included in the down-tapered portion for holding the bore sighter firmly in the muzzle of the firearm while the bore sighting operation is effected.

29 Claims, 3 Drawing Sheets

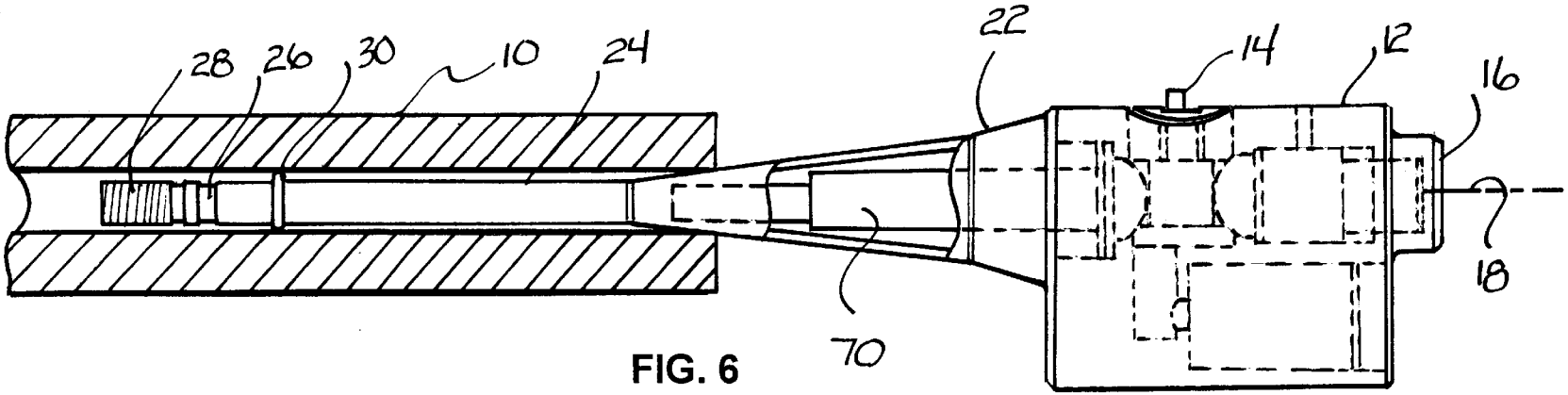
FIG. 6
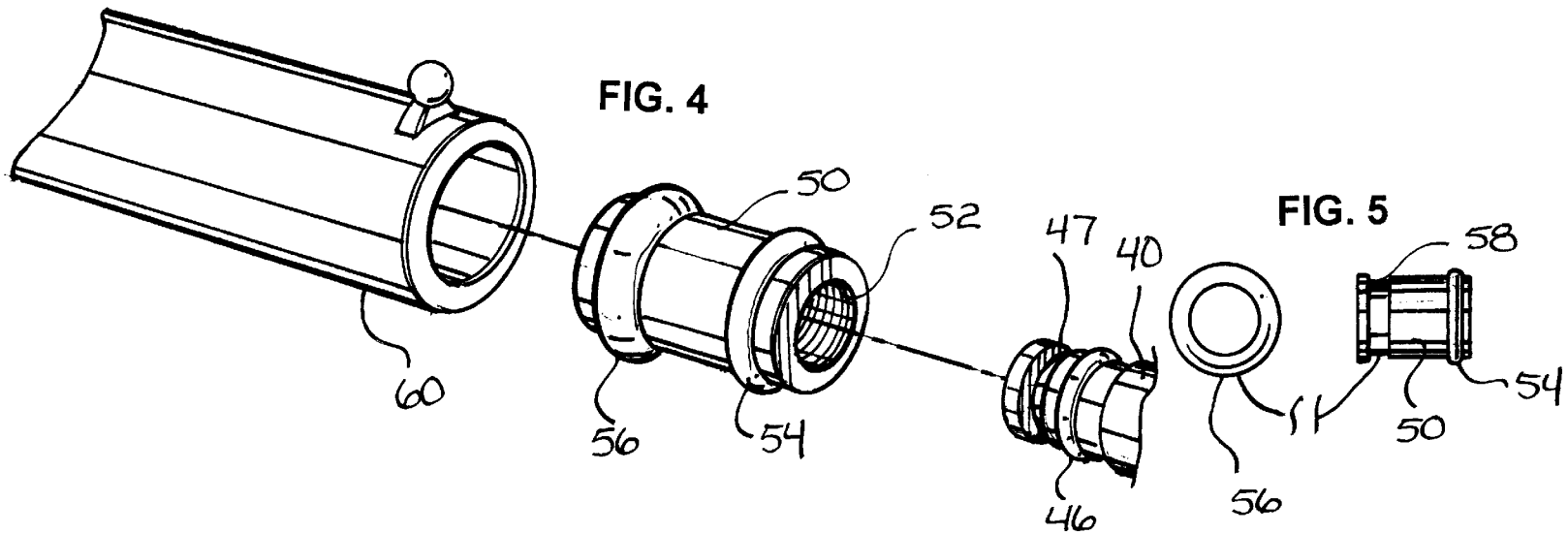
FIG. 5
FIG. 4

BORE SIGHTING APPARATUS

BACKGROUND

In "sighting in" firearms, such as rifles, shotguns, handguns, muzzle loaders, machine guns and cannons, for example, it is necessary to adjust the sights of the firearm at a pre-established angle with the bore of the barrel of the firearm, where the angle is determined by the distance from the muzzle of the firearm to the target, and by the trajectory of the bullet or projectile fired by the firearm. In its most basic form, this has been accomplished by mounting the firearm on a fixed stand or in a fixed position relative to a "sighting in" target. In the past, the target was placed at the actual, final desired distance from the firearm; and a test shot was fired. The point on the target where the bullet or projectile entered the target then was aligned with the sight (whether iron sights or a telescope sight). After this was done, a second shot was fired; and the procedure was repeated until the point of entry of the bullet or projectile aligned with the cross hairs or cross points of the sights. In many cases, a number of shots needed to be fired in order to effect the sighting in procedure.

For each different range or target distance, a separate sighting in procedure needed to be followed. Obviously, a significant amount of ammunition needed to be expended simply to sight in the firearm; and the sighting in needed to be effected in a place where the firing of the actual bullet or projectile from the firearm over the desired distance could be effected safely. The result was a relatively time consuming, costly and potentially dangerous sighting in technique.

U.S. Pat. No. 4,825,258 is directed to a device for sighting in rifles and similar firearms without requiring the expenditure of several rounds of ammunition to effect the sighting in operation. The apparatus of this patent consists of a mounting assembly formed on a body of revolution and having a head portion, a mandrel portion, and a cylinder portion including an expansion tube or expandable arbor. The expandable arbor is inserted into the muzzle of the gun bore and is secured in an axial position; so that it aligns with the central axis of the gun bore. Manipulation of the device is necessary in order to effect the expansion of the arbor; and precautions must be taken not to mar the internal finish of the barrel into which the device is inserted. A light spot generator is mounted in axial alignment with the mounting assembly head portion and the mandrel; so that a light beam projected to a distant target provides a sighting reference for an associated scope or mechanical sight on the rifle. The expandable arbor and the complexity of this device limit its accuracy.

Another type of bore sighter has a mandrel or arbor which is inserted into the muzzle end of the bore of the rifle. A bore sighter with grid lines on it is mounted in an offset position on the arbor, in alignment with the scope or sight of the rifle. Once all of these parts have been secured together, the rifle is placed on a suitable fixed support; and the reticle of the telescopic sights of the rifle are aligned with the cross hairs of a graduated reticle in the bore sighter. The particular alignment is made in accordance with the indication on the grid for the desired range. Once this has been done, sighting in by means of the firing and adjusting of live ammunition is effected to make the final adjustments. Once the final adjustments have been made, the bore sighter once again is mounted on the rifle by inserting the arbor or mandrel into the end of the muzzle; and the recorded reticle position, where the cross hairs of the telescopic sight are in line with the graduated grid reticle in the bore sighter, is made for future reference. Using the scope adjustments, correction for bullet drop at a specific distance, provided the trajectory of a specific load is known, can be made. Each graduation on the bore sighter grid is equivalent to a particular drop at 100 yards. Consequently, when the scope reticle is below the grid center, the gun will shoot high to compensate for the drop or trajectory of the load. This is a relatively cumbersome device to use and requires the firing of live ammunition in its use.

Some types of sighting devices employ a laser beam or light beam mounted on the firearm sights; so that the beam indicates the alignment of the sights vis a vis the target. United States patents directed to this technique are the patents to Vogel U.S. Pat. No. 5,031,349; Idan U.S. Pat. No. 4,665,622; Snyder U.S. Pat. No. 4,295,289; and Snyder U.S. Pat. No. 4,079,534.

Other techniques have been employed for projecting a light through the gun barrel or firearm bore. The light is directed toward a target and is viewed through the firearm sight. Azimuth and elevation adjustments then are made in order to bring the projected light and the sight adjustments into proper alignment. A relatively complex device for accomplishing this purpose is described in the Cameron U.S. Pat. No. 5,060,391. This device employs an optical assembly, a beam splitter and an illumination source in an enclosure. The illumination source is used to provide a visible light which is directed by the beam splitter into the firearm bore, which is illuminated from the muzzle to the chamber. This illumination is viewed through the firearm optical sight; and the proper adjustments are made to bring the images of the muzzle and chamber into coincident alignment. When this accomplished, the cross hair of the firearm optical sight is adjusted to bring the cross hair into the alignment with the muzzle, bore and chamber images.

Another Edwards, U.S. Pat. No. 3,734,627, discloses an apparatus for aligning aircraft guns using a laser. The laser is mounted in a gun barrel; and the laser beam is used to locate a reference point for determining the adjustments needed in aligning the gun with respect to the gun sight. The device of this patent is not readily adaptable to hand-held firearms of various calibers.

Langner U.S. Pat. No. 5,454,168 also is directed to an apparatus for bore sighting hand-held firearms. The apparatus of this patent includes a light source contained within a housing placed in the firing chamber of the firearm. Light is projected from the housing through the bore of the barrel and through the muzzle to a target placed at a pre-established distance from the muzzle. Calibrated points are marked on the target; and the sights of the firearm are adjusted to the calibrated points to effect the bore sighting of the firearm for a specific range. The bore sighting apparatus of this patent includes a housing in the form of a stepped cylindrical section for utilization with different calibers of firearms; but a wide range of different calibers or different types of firearms cannot be employed with a single device.

Another Lanning U.S. Pat. No. 4,481,561 uses a flashlight for bore sighting with a long barreled shotgun or rifle. The flashlight itself includes a cartridge case, with an ejector, rim and primer opening in the base, and a side wall defining an open front end. The battery and light bulb are located within the case; and a switch pin is placed in the primer opening to complete the circuit for illuminating the bulb. When the breach of the gun is closed, a spring coupled with the switch pin is moved to energize the lightbulb.

It is desirable to provide a simple bore sighting device which provides accurate bore sighting, which is capable of utilization with a range of firearms of different types and different calibers, which quickly and effectively facilitates the bore sighting adjustments of the sights of the firearm, and which is easy to use.

SUMMARY OF THE INVENTION

It is an object of this invention to provide an improved bore sighter for a firearm.

It is another object of this invention to provide an improved, easy-to-use bore sighting apparatus for use with firearms of different calibers.

It is an additional object of this invention to provide an improved bore sighting apparatus inserted into the muzzle of a firearm.

It is a further object of this invention to provide an improved bore sighting apparatus inserted into the muzzle of a firearm and held in place during the bore sighting operation by means of magnetic force.

In accordance with a preferred embodiment of this invention, a bore sighting apparatus includes a housing having first and second ends and containing a light source for projecting a beam of light from the first end of the housing. A down-tapered portion extends from the second end of the housing for engaging the muzzle of a firearm. This down-tapered portion includes an extension which fits into the interior of the barrel of a firearm; and a magnet is located in the down-tapered portion to assist in holding the housing in place on the end of the barrel of a firearm when it is in use.

BRIEF DESCRIPTION OF THE DRAWINGS

FIG. 4 is an enlarged exploded view of a variation of the embodiment shown in FIGS. 2 and 3;

FIG. 5 is a detail of a portion of the embodiment shown in FIG. 4; and

FIG. 6 is a partially cut-away side view of a preferred embodiment of the invention.

DETAILED DESCRIPTION

Figure 1:
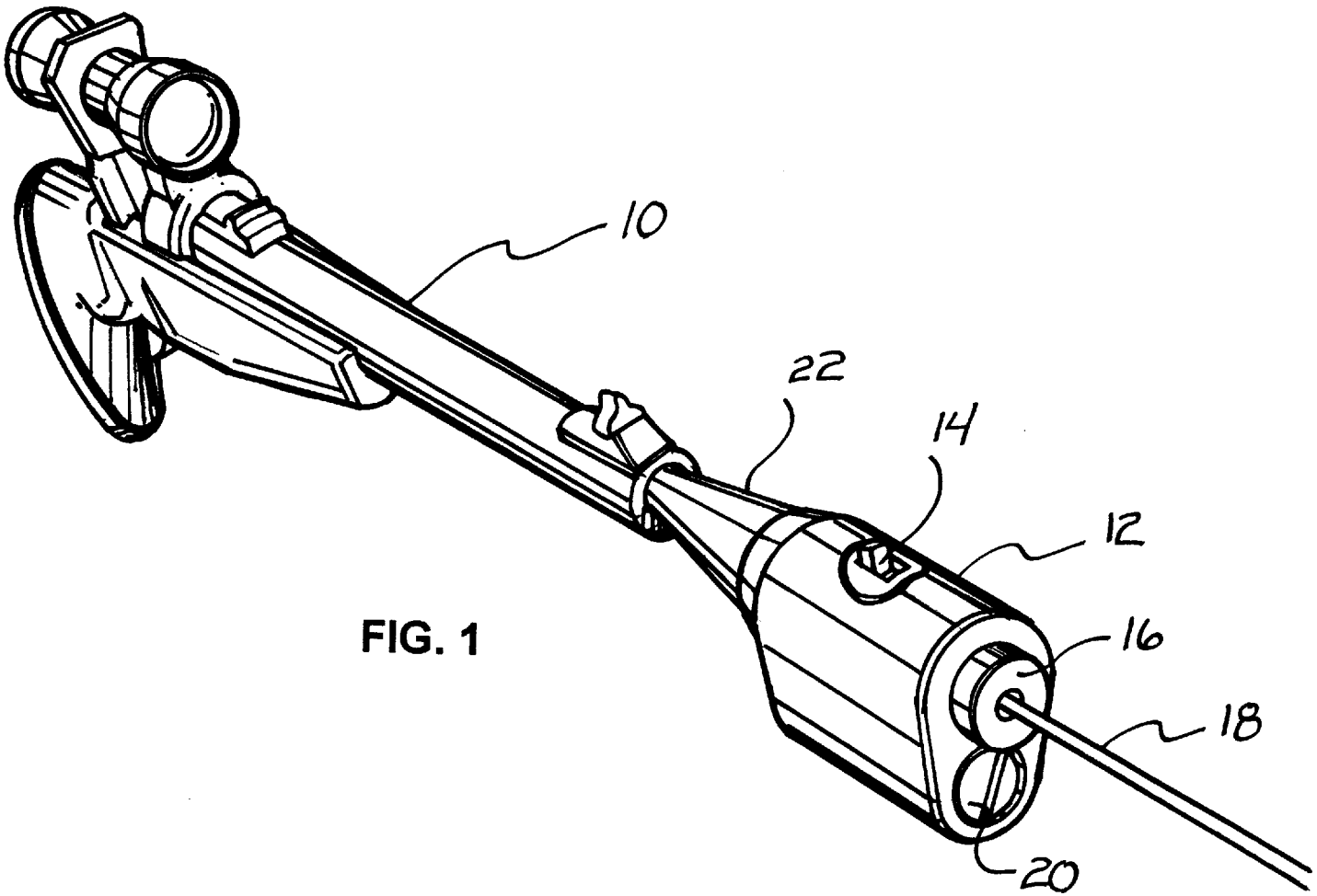
FIG. 1 is a perspective view of a preferred embodiment of the invention illustrating its orientation in use with a firearm.

Reference now should be made to the drawings, in which the same reference numbers are used throughout the different figures to designate the same components. FIG. 1 is a top right perspective view of a preferred embodiment of the invention, as used in conjunction with a firearm, illustrated as a rifle with telescopic sights. The rifle has a barrel 10 and, as illustrated in FIG. 1, the bore sighting device of the preferred embodiment includes a main housing 12 having a light source in it (not illustrated). The light source may be a typical low energy laser light source, or other collimated light source, operated through a simple electrical circuit which is battery powered by a set of batteries 21 (FIG. 3), which are removably placed in the housing through a cap 20. By providing the battery compartment in the lower part of the housing 12 as shown in FIGS. 1 and 6, and by utilizing the cap 20 in the same side of the housing as the side from which the collimated light from the light source is projected, battery replacement can be effected without interfering with the end-to-end alignment of the bore sighting apparatus from the laser light housing to the portion which is extended into the barrel of the firearm, as described subsequently. This is in contrast with the prior art devices which require separation of the laser light source from the portion which is inserted into the bore of the firearm every time a battery must be changed. When the parts of such prior art devices are reconnected, a misalignment between the portions which are inserted into the barrel and the light source frequently takes place. This is prevented by the simple relocation of the batteries and access to the batteries, as shown most clearly in FIGS. 1, 2, 3 and 6.

The light source is turned on and off by means of a simple toggle or slide switch 14 located on the top of the housing 12. A lens or opening 16 is provided in the right-hand end of the housing, as viewed in FIGS. 1, 2 and 3, for projecting a collimated beam of light 18, as illustrated in FIG. 1.

The left-hand end of the housing 12 is integrally formed with, or is attached to, a downwardly-stepped, generally conical section 22, as shown in FIGS. 1, 2, 3 and 6. The section 22 is designed with a base connected to the left-hand end of the housing 12 (as viewed in FIGS. 1, 2, 3 and 6), from which it tapers toward the left, as viewed in the same figures, to terminate in its tip or smallest end in an elongated cylindrical extension 24. As shown most clearly in FIG. 6, the extension 24 is designed to extend a short distance (typically, 2 to 4 inches), inside the barrel 10 of the firearm until the tapered conical portion 22 engages the open muzzle, as shown most clearly in FIG. 6. For the smallest caliber firearm with which the device is to be used (generally, a 22 caliber rifle), the external diameter of the extension 24 is selected to be less than the internal diameter of the bore of the firearm.

In order to center the extension 24 within the bore of the firearm, an O-ring 30 is located in a corresponding groove on the extension 24 to frictionally engage the internal diameter of the bore of the firearm, as shown in FIG. 6. The O-ring 30 is designed to fit into the smallest bore (smallest caliber)of firearm with which the device is to be used. For firearm bores slightly larger than the smallest one engaged by the O-ring 30, an additional groove 26 located to the left (as viewed in FIGS. 2, 3 and 6) of the O-ring 30 is provided. The groove 26 is designed to accommodate larger diameter O-rings (not shown); so that the device may be used with larger diameter bores than the one illustrated in detail in FIG. 6. Obviously, when a larger O-ring is placed in the groove 26, that O-ring engages the interior of the bore of the barrel 10 instead of the O-ring 30, which is designed to be left permanently in place, as illustrated in the various figures of the drawing.

When the device is inserted into the bore of a firearm as illustrated in FIGS. 1 and 6, it is inserted, as described previously, until the diameter of the conical down-tapered section 22, which equals the internal diameter of the bore of the firearm at its muzzle, engages the muzzle as shown in FIG. 6. The device also is made always to be placed in the orientation shown in the various drawings, with the switch 14 on top of the housing 12 aligned with the sights on the top of the barrel 10 of the firearm.

To hold the bore sighting device in place in the position shown in FIG. 6, a single rare earth magnet 70 (or a pair of stepped cylindrical rare earth magnets) is located inside the down-tapered conical section 22 adjacent the end of the barrel 10 of the firearm. The magnet 70 is selected to be a rare earth magnet because of the large amount of magnetic force which is provided from such magnets, even when they are of relatively small size. As shown in FIG. 6, the magnet 70 extends close to or within the bore of the barrel 10 at the muzzle, and aids in holding the entire assembly in its desired fixed location on the end of the barrel 10 of the firearm.

The magnet 70 operates in conjunction with the O-ring 30 (or larger diameter O-rings described above) to accurately center and hold the device during a bore sighting operation which may be effected in a well known manner. After the sighting in operation has been effected, the device is simply withdrawn by pulling it to the right (as shown in the various figures) to remove it from the barrel 10 of the firearm.

Figure 3:
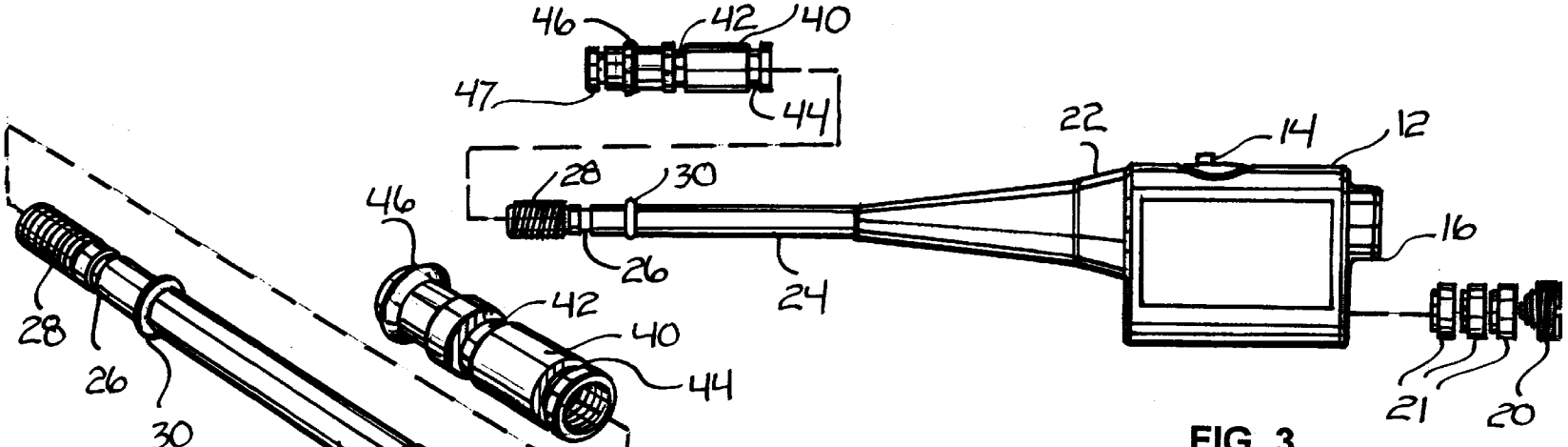
FIG. 3 is a side view of the embodiment shown in FIG. 2.
Figure 2:
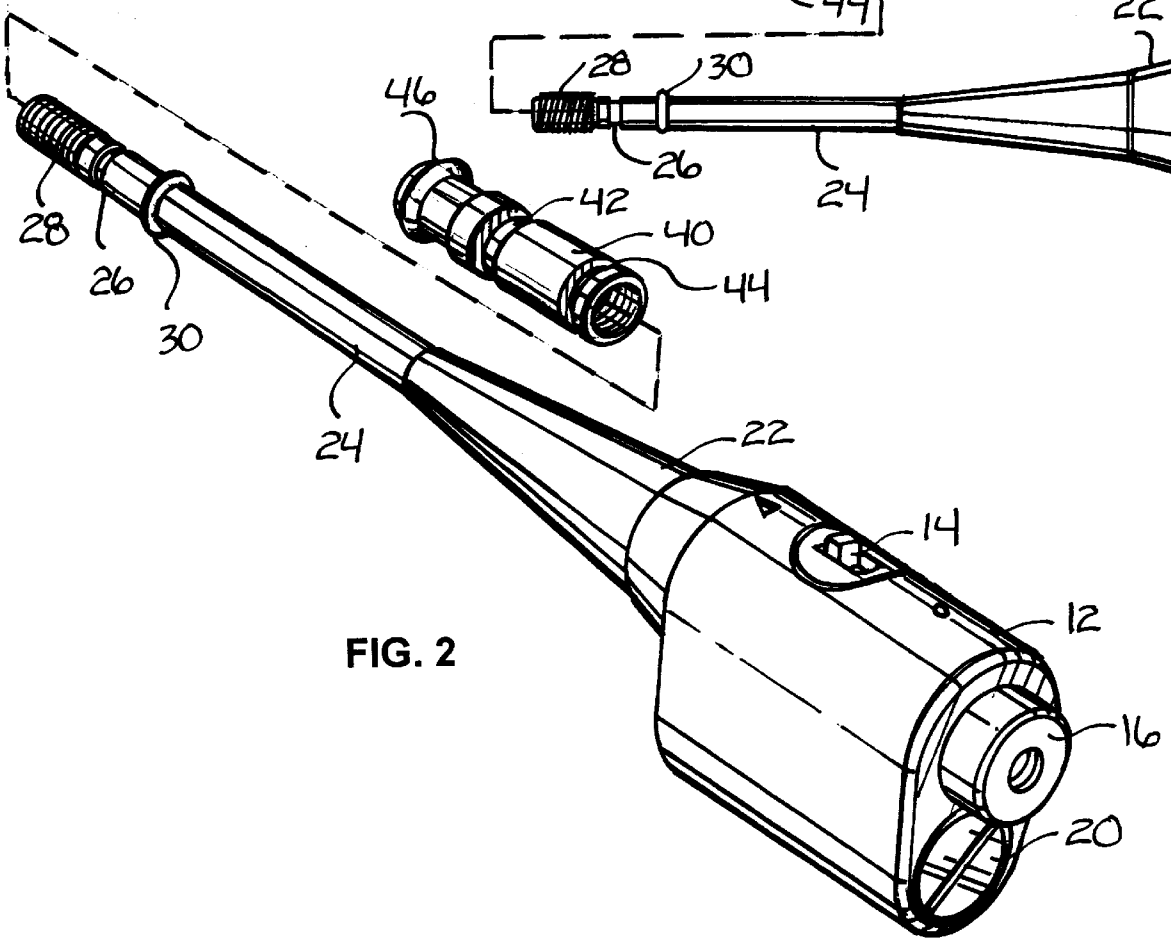
FIG. 2 is a perspective view of the preferred embodiment of the invention illustrating an additional feature thereof.

To permit use of the same device shown and described above in larger diameter bore (larger caliber) firearms, an adapter sleeve 40, as shown in FIGS. 2 and 3, may be threaded onto the externally threaded end 28 of the extension 24. The adapter 40 is internally threaded and has a larger external diameter than the external diameter of the extension 24. When the adapter 40 is placed on the end of the extension 24, it carries a permanent O-ring 46 on its left-hand or distal end for insertion into the lowest caliber firearm for which the extension 40 is designed. To use the extension 40 with larger caliber firearms, a pair of grooves 42 and 44, for holding O-rings of greater diameter than the O-ring 46, are provided. O-rings selected to engage the interior of the bore of a larger caliber firearm are placed within either or both of the grooves 42 or 44; so that the adapter 40 permits use of the device with a range of caliber sizes greater than the range provided by the extension 24 alone.

FIGS. 4 and 5 show yet another adapter which may be used for large-bore firearms, such as shotguns. A shotgun barrel 60 is shown in FIG. 4; and a second, larger adapter 50 is illustrated for insertion over the adapter 40. The adapters 40 and 50 are threaded together by means of the male threads 47 on the end of the adapter 40 and the female threads 52 on the inside of the adapter 50, much in the same manner as the adapter 40 is shown as being threaded onto the end 28 of the extension 24. The adapter 50 carries a permanent O-ring 54 for the smallest diameter bore (for example, 20 gauge) with which it is to be used. Additional, larger O-rings, such as an O-ring 56, however, may be employed for larger diameter bores (such as 12 gauge), and are placed in a circumferential groove 58 on the left-hand of the adapter section 50, as illustrated in FIGS. 4 and 5. The manner in which this is done is similar to the manner described previously for the smallest caliber size ranges used with the extension 24 itself when no adapters are used. In all other respects, the device with or without the adapters 40 and 50, is placed into the muzzle end of the barrel 10 or 60 of the firearm and the magnet 70 holds it in place against rotation and against movement during the sighting in operation.

Obviously, the down-tapered conical section 22 must be made of non-magnetic material in order to obtain the maximum benefit from the magnet 70 located within it. It also is desirable to form the extension 24 of non-magnetic material. In fact the use of non-magnetic material for the housing 12 also is preferable. The down-tapered conical section 22 needs to be hollow in order to permit the insertion and securing of the magnet 70 within it. This section can be made in the form of a hollow aluminum section, or it may made of a number of different composite materials, or high impact plastic materials currently available on the market. Ideally, the extension 24 is a solid, cylindrical section formed either of aluminum or high-impact plastics or suitable composites. When the magnet 70 is placed inside a hollow housing, it is secured in place by means of suitable epoxy. If a composite tapered section 22 is employed, it is possible to form the section 22 around the magnet 70, so that it is permanently formed as an integral part of the tapered section. In any event, the operation of the device is the same, whether a hollow aluminum housing or a plastic or composite housing is used for the down-tapered conical section 22 and/or the extension 24 and the housing 12.

The foregoing description of the preferred embodiment of the invention should be considered as illustrative, and not as limiting. Various changes and modifications will occur to those skilled in the art for performing substantially the same function, in substantially the same way, to achieve substantially the same result, without departing from the true scope of the invention as defined in the appended claims.

What is claimed is:

1. Apparatus for use in bore sighting a firearm including in combination:

a housing with first and second ends containing a light source for projecting a beam of light from the first end thereof;

a down-tapered portion on the second end of the housing for engaging the muzzle of a barrel of a firearm;

an extension on the down-tapered portion for fitting inside the barrel of a firearm, the extension having a first end coupled with the down-tapered portion and a second end designed to extend inside the barrel of a firearm;

an O-ring on the second end of the extension sized to engage the interior of a barrel of a firearm to substantially center the extension in the barrel; and a magnet in the down-tapered portion for assisting in holding the housing in place on the end of a barrel of a firearm.

2. The apparatus according to claim 1 wherein the down-tapered portion is in the form of a generally conical shape, the base of which is coupled with the second end of the housing and the tip of which is coupled with the extension.

3. The apparatus according to claim 2 wherein the largest cross section of the down-tapered portion on the second end of the housing has a diameter greater than the largest diameter of a barrel of a firearm with which the apparatus is to be used.

4. The apparatus according to claim 3 wherein the extension comprises an elongated cylinder having the first end thereof coupled with the tip of the conical section.

5. The apparatus according to claim 4 wherein at least the down-tapered portion on the second end of the housing is made of non-magnetic material.

6. The apparatus according to claim 5 further including a cylindrical adapter designed for removable engagement with the extension and having a diameter greater than the diameter of the extension for assisting in centering the extension in the barrel of a firearm.

7. The apparatus according to claim 6 wherein the adapter has at least one circumferential groove in it and further including an O-ring for placement in the circumferential groove on the adapter for engaging the interior of the barrel of a firearm when the extension with the adapter thereon is inserted into the barrel.

8. The apparatus according to claim 7 wherein the magnet is a rare earth magnet.

9. The apparatus according to claim 8 wherein the non-magnetic material is plastic.

10. The apparatus according to claim 8 wherein the non-magnetic material is aluminum.

11. The apparatus according to claim 8 wherein the non-magnetic material is non-magnetic steel.

12. The apparatus according to claim 1 wherein the extension has a threaded end and further including an adapter having a generally cylindrical configuration and having mating threads for engagement with the threaded end of the extension, the adapter having a diameter greater than the diameter of the extension for assisting in centering the extension in a barrel of a firearm.

13. The apparatus according to claim 12 further including a circular groove about the circumference of the adapter, and an O-ring for placement in the circular groove of the adapter for centering the adapter in a barrel of a firearm.

14. The apparatus according to claim 13 wherein at least the down-tapered portion on the second end of the housing is made of non-magnetic material.

15. The apparatus according to claim 14 wherein the magnet is a rare earth magnet.

16. The apparatus according to claim 1 wherein the largest cross section of the down-tapered portion on the second end of the housing has a diameter greater than the largest diameter of a barrel of a firearm with which the apparatus is to be used.

17. The apparatus according to claim 1 wherein the extension is cylindrical; and further including a cylindrical adapter designed for removable engagement with the extension and having a diameter greater than the diameter of the extension for assisting in centering the extension in the barrel of a firearm.

18. The apparatus according to claim 17 wherein the adapter has at least one circumferential groove in it and further including an O-ring for placement in the circumferential groove on the adapter for engaging the interior of the barrel of a firearm when the extension with the adapter thereon is inserted into the barrel.

19. The apparatus according to claim 1 wherein the magnet is a rare earth magnet.

20. The apparatus according to claim 1 wherein at least the down-tapered portion on the second end of the housing is made of non-magnetic material.

21. The apparatus according to claim 1 wherein the light source emits a collimated beam of light.

22. The apparatus according to claim 1 wherein the light source is a battery powered light source and the housing includes an access opening for allowing battery replacement without removing the down-tapered portion on the second end of the housing.

23. Apparatus for use in bore sighting a firearm including in combination:

a housing with first and second ends containing a light source for projecting a beam of light from the first end thereof;

a down-tapered portion on the second end of the housing for engaging the muzzle of a barrel of a firearm;

an extension on the down-tapered portion for fitting inside the barrel of a firearm, wherein the extension comprises an elongated cylinder having a first end coupled with the down tapered portion, and a second end designed to extend inside the barrel of a firearm; and at least one O-ring on the extension sized to engage the interior of a barrel of a firearm to substantially center the extension in the barrel.

24. The apparatus according to claim 23 wherein the down-tapered portion is in the form of a generally conical shape, the base of which is coupled with the second end of the housing and the tip of which is coupled with the extension.

25. The apparatus according to claim 24 wherein the largest cross section of the down-tapered portion on the second end of the housing has a diameter greater than the largest diameter of a barrel of a firearm with which the apparatus is to be used.

26. The apparatus according to claim 25 and further including a cylindrical adapter designed for removable engagement with the extension and having a diameter greater than the diameter of the extension for assisting in centering the extension in the barrel of a firearm.

27. The apparatus according to claim 26 wherein the adapter has at least one circumferential groove in it and further including an O-ring for placement in the circumferential groove on the adapter for engaging the interior of the barrel of a firearm when the extension with the adapter thereon is inserted into the barrel.

28. The apparatus according to claim 23 wherein the extension has a threaded end and further including an adapter having a generally cylindrical configuration and having mating threads for engagement with the threaded end of the extension, the adapter having a diameter greater than the diameter of the extension for assisting in centering the extension in a barrel of a firearm.

29. The apparatus according to claim 28 further including a circular groove about the circumference of the adapter, and an O-ring for placement in the circular groove of the adapter for centering the adapter in a barrel of a firearm.

* * * * *